US009919886B2

(12) United States Patent
Okubo et al.

(10) Patent No.: US 9,919,886 B2
(45) Date of Patent: Mar. 20, 2018

(54) IMAGE FORMING APPARATUS

(71) Applicant: Konica Minolta, Inc., Chiyoda-ku, Tokyo (JP)

(72) Inventors: Takahiro Okubo, Yokohama (JP); Akihiko Kakita, Kunitachi (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 15/372,967

(22) Filed: Dec. 8, 2016

(65) Prior Publication Data

US 2017/0158446 A1 Jun. 8, 2017

(30) Foreign Application Priority Data

Dec. 8, 2015 (JP) ..... 2015-239046

(51) Int. Cl.

| | |
|---|---|
| ***B65H 9/16*** | (2006.01) |
| ***G03G 15/00*** | (2006.01) |
| ***B65H 5/06*** | (2006.01) |
| ***B65H 9/00*** | (2006.01) |
| ***B65H 7/10*** | (2006.01) |

(Continued)

(52) U.S. Cl.

CPC ..... *B65H 9/16* (2013.01); *B65H 5/062* (2013.01); *B65H 7/10* (2013.01); *B65H 7/20* (2013.01); *B65H 9/002* (2013.01); *B65H 9/103* (2013.01); *G03G 15/6529* (2013.01); *G03G 15/6561* (2013.01); *G03G 15/6567* (2013.01); *B65H 2301/3613* (2013.01); *B65H 2403/21* (2013.01); *B65H 2404/144* (2013.01);

(Continued)

(58) Field of Classification Search

CPC ... B65H 7/00; B65H 7/02; B65H 7/10; B65H 7/20; B65H 9/00; B65H 9/002; B65H 9/004; B65H 9/10; B65H 9/103; B65H 9/106; B65H 9/12; B65H 2301/33; B65H 2301/3613; B65H 2404/144; B65H 2404/1441; B65H 2404/1442; B65H 9/16

USPC ..... 271/249, 250, 252

See application file for complete search history.

(56) References Cited

U.S. PATENT DOCUMENTS

2009/0134569 A1* 5/2009 Matsui ..... B65H 7/10 271/227
2010/0276872 A1* 11/2010 Krucinski ..... B65H 7/08 271/228

(Continued)

FOREIGN PATENT DOCUMENTS

JP 2007022680 A 2/2007
JP 2012162350 A 8/2012

*Primary Examiner* — Prasad V Gokhale
(74) *Attorney, Agent, or Firm* — Cantor Colburn LLP

(57) ABSTRACT

An image forming apparatus includes: a pair of first rollers configured to nip a paper sheet in a reference position and convey the paper sheet, the pair of first rollers being pressed against each other; and a control unit configured to control operation of the pair of first rollers to correct a positional deviation in a width direction of the paper sheet, by moving the pair of first rollers from the reference position in the width direction perpendicular to a direction of conveyance of the paper sheet, wherein, the control unit controls the operation of the pair of rollers, to complete a series of operations for the pair of rollers to separate from each other, to return to the reference position, and to be again pressed against each other, before a bottom edge of the paper sheet nipped by the pair of rollers passes through the pair of rollers.

7 Claims, 11 Drawing Sheets

(51) Int. Cl.
*B65H 9/10* (2006.01)
*B65H 7/20* (2006.01)

(52) U.S. Cl.
CPC ..... *B65H 2404/1424* (2013.01); *B65H 2511/414* (2013.01); *B65H 2513/50* (2013.01); *B65H 2553/82* (2013.01)

(56) References Cited

U.S. PATENT DOCUMENTS

2011/0316226 A1* 12/2011 Karikusa ..... B65H 7/02 271/226
2013/0214482 A1* 8/2013 Matsumoto ..... B65H 7/10 271/228
2015/0071692 A1* 3/2015 Maruta ..... B65H 3/0669 399/361
2015/0115525 A1* 4/2015 Deno ..... B65H 9/006 271/227
2016/0159598 A1* 6/2016 Yamane ..... B65H 9/002 271/227

* cited by examiner

FIG. 9

| IMAGE FORMING CONDITION No. | CONVEYANCE PATH | PAPER SHEET | | PRIORITY MODE |
|---|---|---|---|---|
| | | BASIS WEIGHT | SIZE | |
| 1 | Da | ALL | ALL | PRODUCTIVITY |
| 2 | Db | NOT MORE THAN 180 g/m$^2$ | ALL | PRODUCTIVITY |
| 3 | Db | ALL | NOT LARGER THAN 240 mm | PRODUCTIVITY |
| 4 | Db | MORE THAN 180 g/m$^2$ | LARGER THAN 240 mm | PRODUCTIVITY/ CONVEYANCE |

IMAGE FORMING APPARATUS

The entire disclosure of Japanese Patent Application No. 2015-239046 filed on Dec. 8, 2015 including description, claims, drawings, and abstract are incorporated herein by reference in its entirety.

BACKGROUND OF THE INVENTION

Field of the Invention

The present invention relates to an image forming apparatus.

Description of the Related Art

An electrophotographic image forming apparatus forms an image on an image carrier by using a color material such as toner, and presses a paper sheet against the image carrier with a pair of transfer rollers, to transfer the image from the image carrier onto the paper sheet.

A pair of resist rollers are provided immediately in front of the pair of transfer rollers, and the top edge of a paper sheet is made to align against the nip line formed by the pair of resist rollers. In this manner, a tilt of the paper sheet during the transfer is normally corrected. Further, the pair of resist rollers nipping the paper sheet are moved in the width direction perpendicular to the conveyance direction, so that a positional deviation in the width direction of the paper sheet can be corrected (see JP 2007-22680 A, for example).

When nipping a paper sheet, the pair of resist rollers are located in the reference position. When correcting a positional deviation in the width direction, the pair of resist rollers move from the reference position while nipping the paper sheet. After that, to prepare for conveyance of the next paper sheet, the pair of resist rollers separate from each other, release the paper sheet, and then return to the reference position.

If the timing to separate is too early, the pair of resist rollers cannot sufficiently assist the pair of transfer rollers in conveying the paper sheet, and a conveyance defect might occur.

In conventional cases, conveyance control is performed so that the pair of resist rollers start separating from each other and return to the reference position when the bottom edge of a paper sheet passes immediately in front of the pair of resist rollers after the pair of resist rollers nipping the paper sheet have moved in the width direction (see JP 2012-162350 A, for example). In this manner, the pair of resist rollers can assist the conveyance of almost an entire paper sheet in the time between the arrival of the top edge of the paper sheet at the pair of transfer rollers and the passing of the bottom edge of the paper sheet at the pair of resist rollers.

By the above described conventional conveyance control, the pair of resist rollers start separating from each other immediately before the bottom edge of a paper sheet passes therethrough. Accordingly, the intervals between paper sheets can be made shorter than those in a case where the pair of resist rollers start separating from each other after the bottom edge of a paper sheet passes therethrough. As the sheet conveyance speed can be increased, productivity can be improved.

However, only the short time immediately before or after the bottom edge of a paper sheet passes through the pair of resist rollers can be shortened, and the increase in productivity is not enough.

SUMMARY OF THE INVENTION

In view of the above, an object of the present invention is to perform sheet conveyance control with high productivity and sufficiently high conveying performance.

To achieve the abovementioned object, according to an aspect, an image forming apparatus reflecting one aspect of the present invention comprises:

a pair of first rollers configured to nip a paper sheet in a reference position and convey the paper sheet, the pair of first rollers being pressed against each other; and a control unit configured to control operation of the pair of first rollers to correct a positional deviation in a width direction of the paper sheet, by moving the pair of first rollers from the reference position in the width direction perpendicular to a direction of conveyance of the paper sheet after the pair of first rollers nip the paper sheet, wherein, after correcting the positional deviation, the control unit controls the operation of the pair of first rollers, to complete a series of operations for the pair of first rollers to separate from each other, to return to the reference position, and to be again pressed against each other, before a bottom edge of the paper sheet nipped by the pair of first rollers passes through the pair of first rollers.

According to an invention of Item. 2, there is provided the image forming apparatus of Item. 1, preferably further comprising a pair of second rollers adjacent to a downstream side of the pair of first rollers in the direction of conveyance of the paper sheet, wherein the control unit preferably controls the pair of first rollers to start separating from each other when a top edge of the paper sheet nipped by the pair of first rollers reaches the pair of second rollers.

According to an invention of Item. 3, there is provided the image forming apparatus of Item. 2, wherein the control unit preferably selects one of a productivity priority mode and a conveyance priority mode in accordance with a conveyance path of the paper sheet and a basis weight and a size of the paper sheet, in the productivity priority mode, the control unit preferably performs control to complete the series of operations before the bottom edge of the paper sheet nipped by the pair of first rollers passes through the pair of first rollers, and, in the conveyance priority mode, the control unit preferably performs control to start the series of operations immediately before or after the bottom edge of the paper sheet nipped by the pair of first rollers passes through the pair of first rollers.

According to an invention of Item. 4, there is provided the image forming apparatus of Item. 3, wherein, when the conveyance path of the paper sheet is a conveyance path including a bent portion, the basis weight of the paper sheet is greater than a threshold, and the size of the paper sheet in the conveyance direction is longer than a conveyance path from the pair of second rollers to the bent portion, the control unit preferably performs control in a priority mode designated by a user between the productivity priority mode and the conveyance priority mode.

According to an invention of Item. 5, there is provided the image forming apparatus of Item. 4, wherein, when the productivity priority mode is designated by the user, the control unit preferably restricts the timing for the pair of first rollers to start separating from each other to a time after the bottom edge of the paper sheet nipped by the pair of first rollers passes through the bent portion of the conveyance path.

According to an invention of Item. 6, there is provided the image forming apparatus of any one of Items. 1 to 5, wherein, when the pair of first rollers are again pressed against each other, the control unit preferably controls respective sheet conveyance speeds of the pair of first rollers and the pair of second rollers to synchronize with each other.

According to an invention of Item. 7, there is provided the image forming apparatus of any one of Items. 1 to 6, wherein, when the pair of first rollers are again pressed against each other, the control unit preferably adjusts a moving speed of each roller to a lower speed than a reference speed.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein:

FIG. 9 is a table showing the correspondence between image forming conditions and the priority modes that can be selected under the respective image forming conditions.

DESCRIPTION OF THE PREFERRED EMBODIMENTS

Hereinafter, an image forming apparatus according to an embodiment of the present invention will be described with reference to the drawings. However, the scope of the invention is not limited to the illustrated examples.

Figure 1:
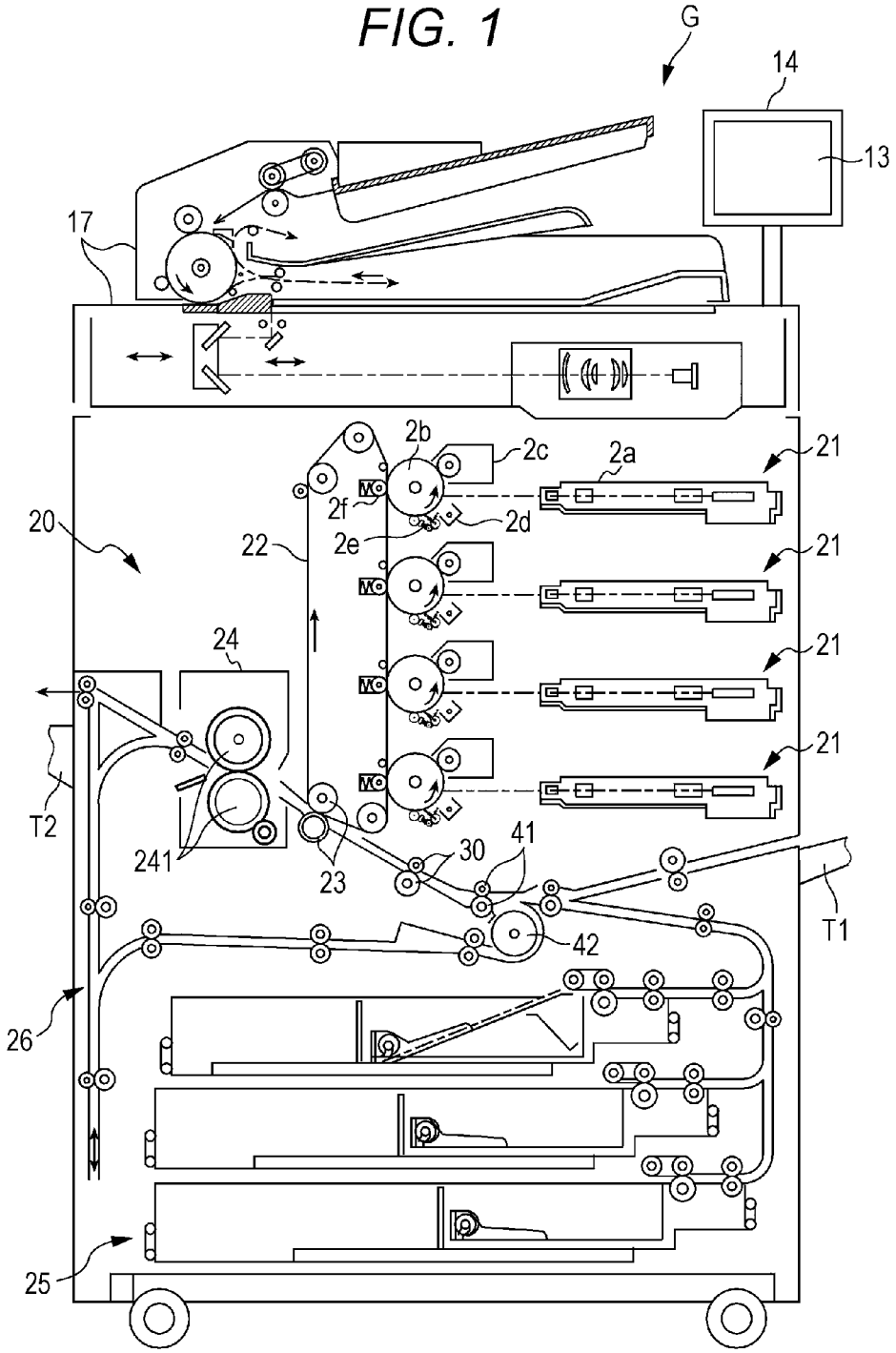
FIG. 1 is a schematic front view of the structure of an image forming apparatus according to an embodiment of the present invention.

FIG. 1 schematically shows the structure of an image forming apparatus G according to this embodiment.

The image forming apparatus G includes an image forming unit 20 as shown in FIG. 1, and forms an image on a paper sheet with the image forming unit 20 using a color material such as toner.

Figure 2:
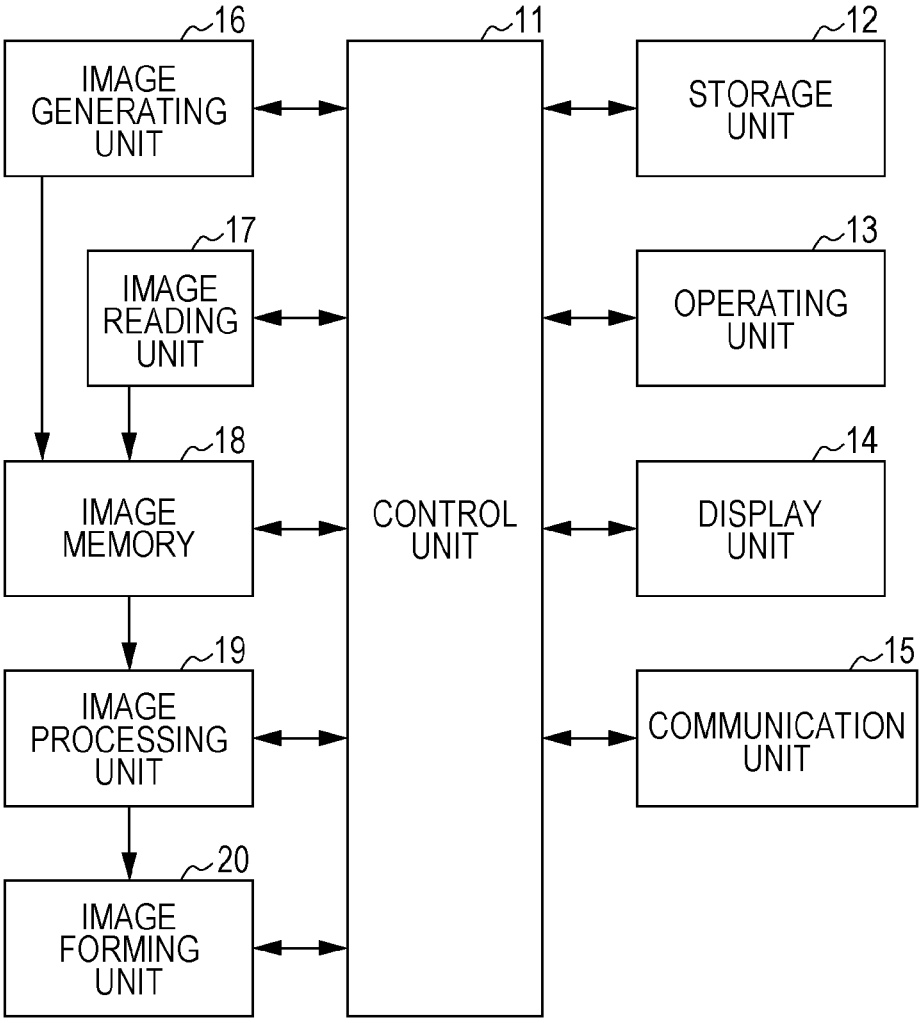
FIG. 2 is a block diagram showing the respective functions in the configuration of the image forming apparatus.

FIG. 2 is a block diagram showing the principal functions in the configuration of the image forming apparatus G.

As shown in FIGS. 1 and 2, the image forming apparatus G includes a control unit 11, a storage unit 12, an operating unit 13, a display unit 14, a communication unit 15, an image generating unit 16, an image reading unit 17, an image memory 18, an image processing unit 19, and the image forming unit 20.

The control unit 11 includes a central processing unit (CPU), a random access memory (RAM), and the like. The control unit 11 reads various programs from the storage unit 12 and executes them, to control the respective components.

For example, the control unit 11 controls the image processing unit 19 to perform image processing on an original image that has been generated by the image generating unit 16 or the image reading unit 17 and is stored in the image memory 18. The control unit 11 then controls the image forming unit 20 to form an image on a paper sheet in accordance with the original image subjected to the image processing.

The control unit 11 also controls sheet conveyance. In one of the sheet control operations, the control unit 11 controls the operation of a pair of resist rollers 30 that correct a tilt and a positional deviation of the paper sheet onto which an image is to be transferred.

Specifically, after the pair of resist rollers 30 nip the paper sheet, the control unit 11 moves the pair of resist rollers 30 from the reference position in the width direction perpendicular to the sheet conveying direction, and controls the operation of the pair of resist rollers 30 to correct the positional deviation of the paper sheet. After correcting the positional deviation, the control unit 11 controls the operation of the pair of resist rollers 30 to complete a series of operations (operations to prepare for conveyance of the next paper sheet) so that the pair of resist rollers 30 separate from each other, return to the reference position, and are again pressed against each other before the bottom edge of the paper sheet nipped by the pair of resist rollers 30 passes through the pair of resist rollers 30.

The storage unit 12 stores programs that can be read by the control unit 11, and files and the like to be used in executing the programs. The storage unit 12 may be a large-capacity memory, such as a hard disk.

As shown in FIG. 1, the operating unit 13 and the display unit 14 are provided as user interfaces on an upper portion of the image forming apparatus G.

The operating unit 13 generates an operation signal in accordance with a user operation, and outputs the operation signal to the control unit 11. The operating unit 13 may be a keypad, a touch panel integrated with the display unit 14, or the like.

The display unit 14 displays an operation screen or the like in accordance with an instruction from the control unit 11. The display unit 14 may be a liquid crystal display (LCD), an organic electro-luminescence display (OELD), or the like.

The communication unit 15 communicates with an external device in a network, such as a user terminal, a server, or another image forming system.

The communication unit 15 receives vectorial data from a user terminal via a network. In the vectorial data, an instruction to form an image is written in a page description language (PDL).

The image generating unit 16 rasterizes the vectorial data received by the communication unit 15, and generates an original image in a bitmap format. In the original image, each pixel has pixel values of the four colors; cyan (C), magenta (M), yellow (Y), and black (K). A pixel value is a data value representing a gradation in an image, and an 8-bit data value represents a gradation at level 0 to 255, for example.

The image reading unit 17 is formed with an automatic document feeder, a scanner, and the like, as shown in FIG. 1. The image reading unit 17 reads a surface of a document set on a platen, and generates an original image in a bitmap format. In the original image generated by the image reading unit 17, each pixel has pixel values of the three colors: red (R), green (G), and blue (B). This original image is subjected to color conversion, and is converted into an original image having pixel values of the four colors C, M, Y, and K by a color converting unit (not shown).

The image memory 18 is a buffer memory that temporarily stores an original image generated by the image generating unit 16 or the image reading unit 17. The image memory 18 maybe a dynamic RAM (DRAM) or the like.

The image processing unit 19 reads the original image from the image memory 18, and performs image processing, such as a density correction process or a halftone process, on the original image.

The density correction process is a process to convert the pixel values of the respective pixels of the original image into pixel values that are corrected so that the density of the image formed on a paper sheet matches the target density.

The halftone process is a process for reproducing a halftone in a simulative manner, and may be an error diffusion process, a screen process using an organizational dither method, or the like.

The image forming unit 20 forms an image formed with the four colors C, M, Y, and K on a paper sheet, in accordance with the pixel values of the four colors of the respective pixels in the original image subjected to the image processing by the image processing unit 19.

As shown in FIG. 1, the image forming unit 20 includes four writing units 21, an intermediate transfer belt 22, a pair of secondary transfer rollers 23, a fixing device 24, a sheet feed tray 25, a manual sheet feed tray T1, and a sheet catch tray T2.

The four writing units 21 are arranged in series (in tandem) along the belt surface of the intermediate transfer belt 22, and forms images in the respective colors C, M, Y, and K. The respective writing units 21 have the same structures, except that the colors of the images to be formed are different from one another. As shown in FIG. 1, each writing unit 21 includes an optical scanner 2*a*, a photosensitive member 2*b*, a developing unit 2*c*, a charging unit 2*d*, a cleaning unit 2*e*, and a primary transfer roller 2*f*.

At a time of image formation, after the photosensitive member 2*b* is electrically charged by the charging unit 2*d*, each writing unit 21 forms an electrostatic latent image by scanning the photosensitive member 2*b* with a flux of light emitted from the optical scanner 2*a* in accordance with the original image. The developing unit 2*c* performs development by supplying a color material such as toner, so that an image is formed on the photosensitive member 2*b*.

The images formed on the respective photosensitive members 2*b* of the four writing units 21 are sequentially transferred onto the intermediate transfer belt 22 in an overlapping manner by the respective primary transfer rollers 2*f* (this process is the primary transfer). Consequently, an image formed with the respective colors is formed on the intermediate transfer belt 22. The intermediate transfer belt 22 is an image carrier that is turned by rollers. After the primary transfer, the cleaning unit 2*e* removes the remaining color material from the photosensitive member 2*b*.

A paper sheet is supplied from the sheet feed tray T1 or 25 to the image forming unit 20 in time for the image on the turning intermediate transfer belt 22 reaching the position of the pair of secondary transfer rollers 23. As the pair of secondary transfer rollers 23 are pressed against each other, the image is transferred from the intermediate transfer belt 22 onto the paper sheet (this process is called the secondary transfer). The paper sheet is then conveyed to the fixing device 24 and is subjected to a fixing process. The paper sheet is then ejected onto the sheet catch tray T2. The fixing process is a process of heating and pressing the paper sheet with a pair of fixing rollers 241, to fix the image to the paper sheet. In a case where images are to be formed on both surfaces of a paper sheet, the paper sheet is conveyed into a conveyance path 26, is reversed, and is then returned to the position of the pair of secondary transfer rollers 23.

Figure 3:
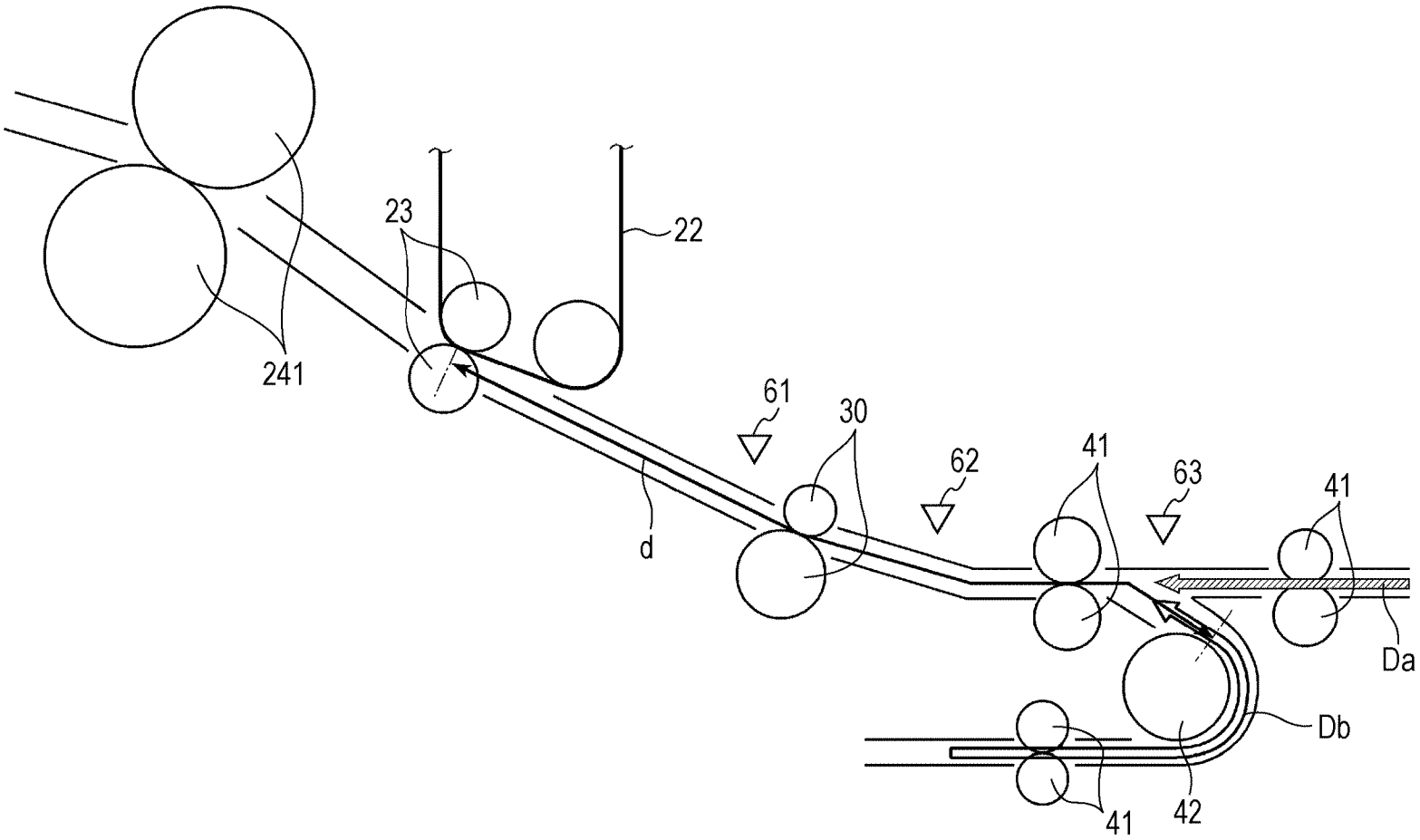
FIG. 3 is an expanded view of the sheet conveyance path to a pair of secondary transfer rollers.

FIG. 3 shows the sheet conveyance path to the pair of secondary transfer rollers 23.

As shown in FIG. 3, the pair of resist rollers 30 are located adjacent to the upstream side of the pair of secondary transfer rollers 23 in the sheet conveying direction, and the pair of fixing rollers 241 are located adjacent to the downstream side of the pair of secondary transfer rollers 23. Of the pair of secondary transfer rollers 23, one roller is pressed against the intermediate transfer belt 22, and the other roller serves as one of the rollers that turn the intermediate transfer belt 22. The pair of resist rollers 30 are capable of rotating forward and rotating backward, and can move in the width direction perpendicular to the sheet conveying direction.

Further, sensors 61 through 63 are disposed along the conveyance path.

The sensor 61 is located adjacent to the pair of resist rollers 30, and detects a positional deviation of a paper sheet in its width direction. The sensor 62 is located between the pair of resist rollers 30 and a pair of rollers 41 immediately in front of the pair of resist rollers 30, and detects the bottom edge of the paper sheet nipped by the pair of resist rollers 30. The sensor 63 is located on the upstream side of the sensor 62 in the conveying direction, and detects the top edge of the paper sheet being conveyed to the pair of resist rollers 30. Each of the sensors 61 through 63 may be an optical sensor or the like.

As shown in FIG. 3, the conveyance path to the pair of resist rollers 30 includes a conveyance path Da for paper sheets supplied from the sheet feed tray T1 or 25, and a conveyance path Db for paper sheets reversed by the conveyance path 26. The conveyance path Da has a low curvature, and a paper sheet can be conveyed almost straight in the conveyance path Da by the pair of rollers 41. However, a roller 42 is provided in the conveyance path Db, and a paper sheet is conveyed in the conveyance path Db as if folded back by this roller 42. Therefore, the conveyance path Db has a bent portion with a high curvature. In FIG. 3, the distance from the pair of secondary transfer rollers 23 to this bent portion is denoted by d.

Figure 4:
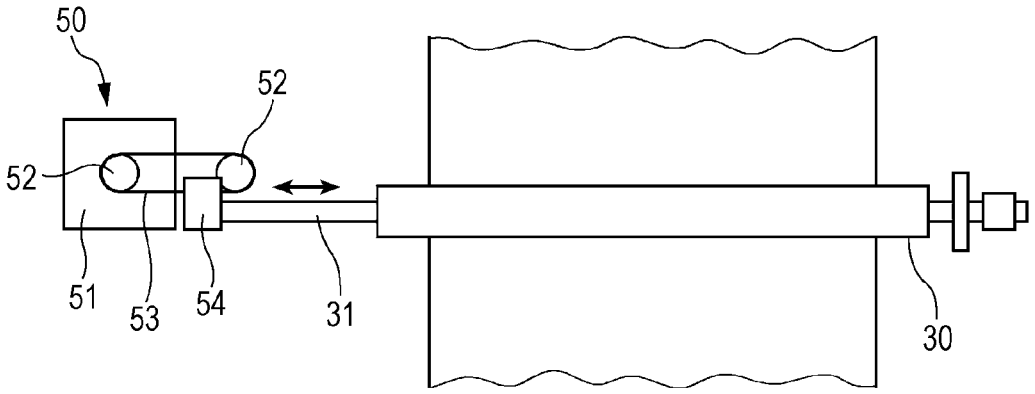
FIG. 4 is a top view of an example of a moving/driving unit for a pair of resist rollers.

FIG. 4 is a top view of a moving/driving unit 50 for the pair of resist rollers 30, seen from above a paper sheet.

As shown in FIG. 4, the moving/driving unit 50 includes a motor 51, two gears 52, a timing belt 53 stretched around the two gears 52, and a joining member 54 that joins the timing belt 53 and a rotating shaft 31 of the pair of resist rollers 30 to each other. One of the two gears 52 is connected to the output shaft of the motor 51.

When a positional deviation in the width direction of a paper sheet is to be corrected, the motor 51 rotates at an angle equivalent to the amount of correction of the positional deviation. This rotation is transmitted to the rotating shaft 31 via the gears 52 and the timing belt 53, and the pair of resist rollers 30 then move in the axial direction of the rotating shaft 31 or the width direction of the paper sheet.

From the position after the moving, the motor 51 reversely rotates at the same angle as the angle at the time of the moving, so that the pair of resist rollers 30 can be moved in the opposite direction from the direction at the time of the positional deviation correction. Thus, the pair of resist rollers 30 can be returned to the reference position where the pair of resist rollers 30 were located before the moving. This reference position is also called the home position (HP).

FIGS. 5A through 5E show the operations of the pair of resist rollers 30 at a time when a tilt of a paper sheet and a positional deviation in the width direction are corrected.

Figure 5A:
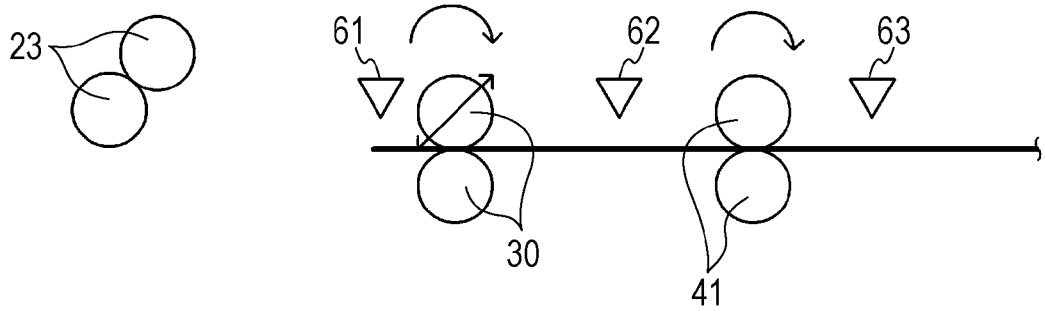
FIG. 5A is a front view illustrating an operation of the pair of resist rollers in a productivity priority mode.

As shown in FIG. 5A, when the sensor 61 detects a positional deviation in the width direction of a paper sheet after the paper sheet is nipped by the pair of resist rollers 30 in the reference position, the moving/driving unit 50 moves the pair of resist rollers 30 in the width direction of the paper sheet from the reference position in accordance with the amount of the detected positional deviation, so that the positional deviation of the paper sheet is corrected.

Figure 5B:
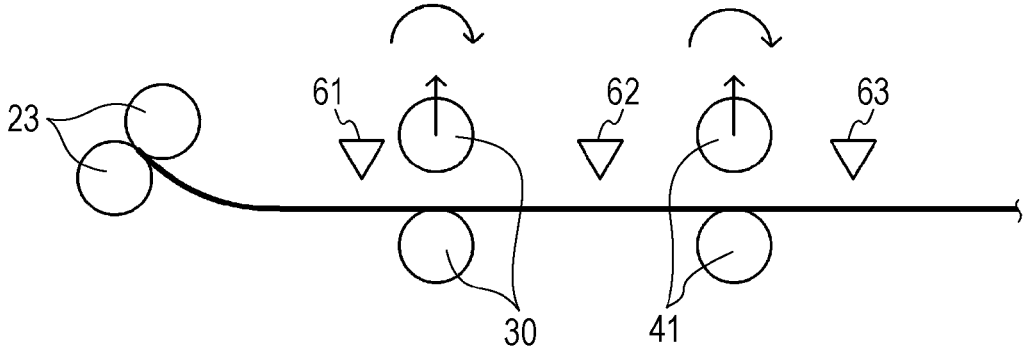
FIG. 5B is a front view illustrating an operation of the pair of resist rollers in the productivity priority mode.

As shown in FIG. 5B, when the top edge of the paper sheet nipped by the pair of resist rollers 30 reaches the pair of secondary transfer rollers 23, the operations to prepare for conveyance of the next paper sheet are started.

Figure 5C:
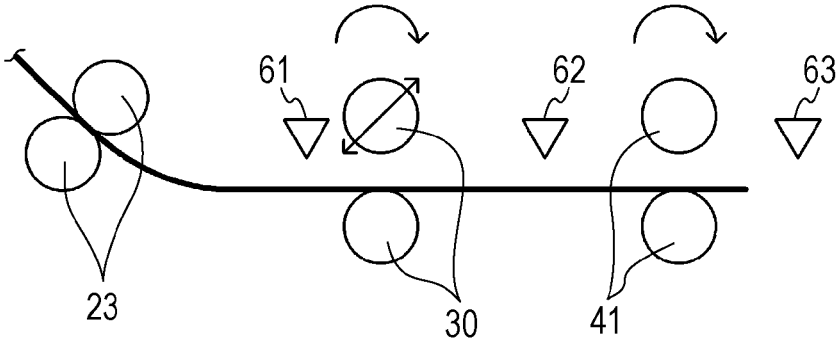
FIG. 5C is a front view illustrating an operation of the pair of resist rollers in the productivity priority mode.
Figure 5D:
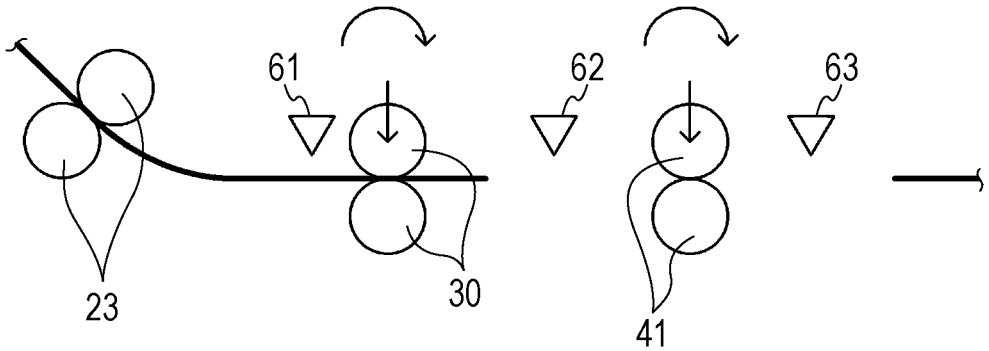
FIG. 5D is a front view illustrating an operation of the pair of resist rollers in the productivity priority mode.

Specifically, the pair of resist rollers 30 start separating from each other, and the pair of rollers 41 start separating from each other, as shown in FIG. 5B. To return the pair of resist rollers 30 to the reference position, the moving/driving unit 50 starts moving the pair of resist rollers 30 in the width direction of the paper sheet, as shown in FIG. 5C. After the moving to the reference position, the pair of resist rollers 30 are again pressed against each other, and the pair of rollers 41 are also again pressed against each other, as shown in FIG. 5D. The series of operations from the separation to the re-contact are completed as the operations to prepare for conveyance of the next paper sheet, before the bottom edge of the paper sheet passes through the pair of resist rollers 30. Because of this, the next paper sheet can be conveyed immediately after the current paper sheet has passed through the pair of resist rollers 30. Accordingly, the intervals between paper sheets can be shortened, and the sheet conveyance speed can be increased. Furthermore, the conveyance of the paper sheet by the pair of secondary transfer rollers 23 can be assisted by the pair of resist rollers 30 that are again pressed against each other.

To facilitate the conveyance by the pair of resist rollers 30, the control unit 11 preferably controls the pair of resist rollers 30 to continue to rotate after separating from each other as shown in FIG. 5B.

When the pair of resist rollers 30 are again pressed against each other, the control unit 11 preferably controls the sheet conveyance speeds or the rotating speeds of the pair of resist rollers 30 and the pair of secondary transfer rollers 23 to synchronize with each other.

In this manner, the tension of the paper sheet can be maintained at a constant level even when the pair of resist rollers 30 are again pressed against each other and assist the conveyance of the paper sheet being conveyed by the pair of secondary transfer rollers 23. Thus, conveyance defects, such as pulling or sagging of a paper sheet, can be prevented.

Furthermore, the control unit 11 preferably controls the moving speed of the respective rollers at the time of the re-contact of the pair of resist rollers 30 to become lower than the reference speed during the regular pressure contact.

In this manner, the impact to be caused at the time when the pair of resist rollers 30 pressed against each other come into contact with the paper sheet being conveyed by the pair of secondary transfer rollers 23 can be made smaller, and conveyance defects due to contact can be reduced.

The control unit 11 can also perform control so that the pair of resist rollers 30 again pressed against each other have the same sheet conveying force as the conveying force of the pair of secondary transfer rollers 23.

In this manner, conveyance defects, such as pulling of a paper sheet due to a difference in conveying force between the pair of resist rollers 30 and the pair of secondary transfer rollers 23, can be reduced.

The conveying force of a pair of rollers can be determined by multiplying the nip pressure of the pair of rollers by the friction coefficient of the roller surfaces. Accordingly, it is possible to control the conveying force by adjusting the nip pressure in practice.

The pair of secondary transfer rollers 23 are normally controlled to have a sufficient nip pressure for transfer, and the nip pressure is often lower than the nip pressure of the pair of resist rollers 30. However, the nip pressure at the time when the pair of resist rollers 30 are again pressed against each other is controlled to be the same as the nip pressure of the pair of secondary transfer rollers 23. In this manner, the pair of secondary transfer rollers 23 and the pair of resist rollers 30 can be controlled to have the same conveying force.

When the sensor 63 detects the top edge of the next paper sheet after the completion of the operations to prepare for conveyance of the next sheet, the pair of rollers 41 rotate forward in the same manner as in the conveyance, and the pair of resist rollers 30 rotate backward.

Figure 5E:
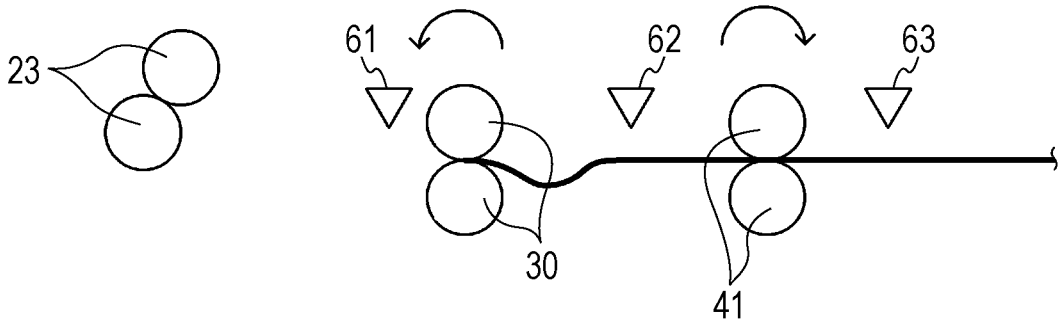
FIG. 5E is a front view illustrating an operation of the pair of resist rollers in the productivity priority mode.

After the top edge of the paper sheet collides with the nip between the pair of resist rollers 30 rotating backward, the paper sheet is further conveyed by the pair of rollers 41 rotating forward until the paper sheet is bent, as shown in FIG. 5E. In this manner, the top edge of the paper sheet aligns against the nip line, and the tilt of the paper sheet is corrected. After that, the pair of resist rollers 30 are made to rotate forward, and nip the paper sheet as shown in FIG. 5A.

FIGS. 6A through 6F show the conventional operations of the pair of resist rollers 30 at a time when a tilt of a paper sheet and a positional deviation in the width direction are corrected.

Figure 6A:
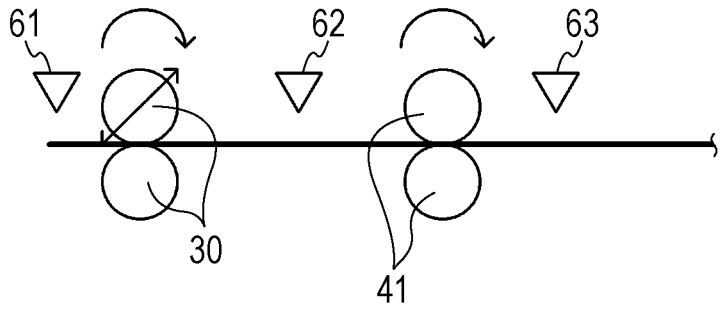
FIG. 6A is a front view illustrating an operation of the pair of resist rollers in a conveyance priority mode.

As shown in FIG. 6A, when the sensor 61 detects a positional deviation after the pair of resist rollers 30 are pressed against each other and nip the paper sheet, the moving/driving unit 50 moves the pair of resist rollers 30 in the width direction of the paper sheet from the reference position, so that the positional deviation of the paper sheet is corrected.

Figure 6B:
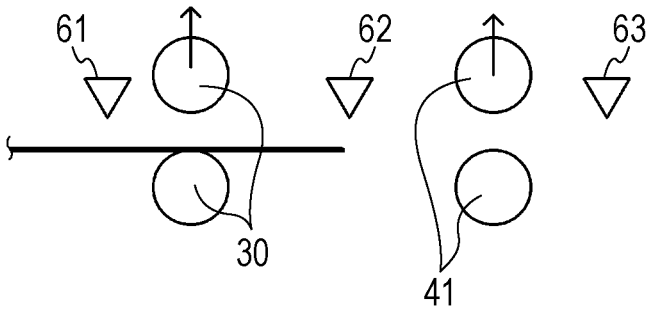
FIG. 6B is a front view illustrating an operation of the pair of resist rollers in the conveyance priority mode.

After that, when the sensor 62 located immediately in front of the pair of resist rollers 30 detects the bottom edge of the paper sheet nipped by the pair of resist rollers 30 as shown in FIG. 6B, the operations to prepare for conveyance of the next paper sheet are started.

Figure 6C:
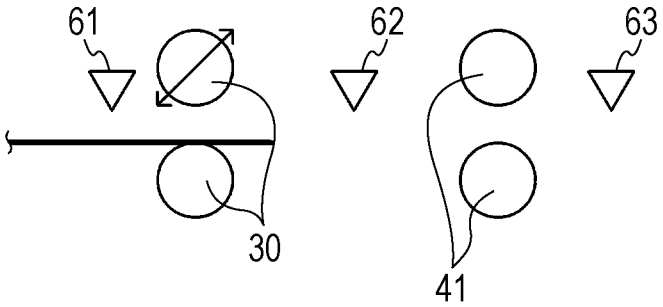
FIG. 6C is a front view illustrating an operation of the pair of resist rollers in the conveyance priority mode.
Figure 6D:
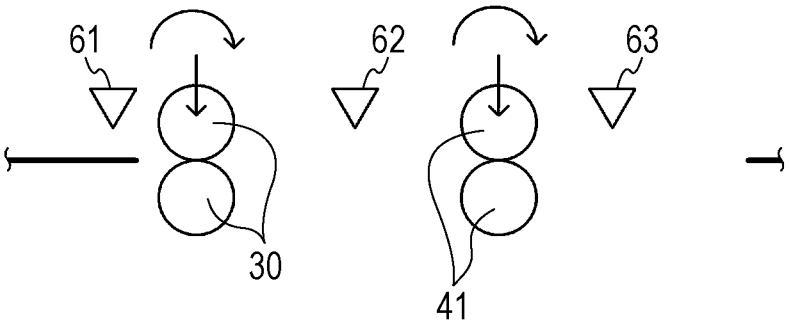
FIG. 6D is a front view illustrating an operation of the pair of resist rollers in the conveyance priority mode.

Specifically, the pair of resist rollers 30 and the pair of rollers 41 are made to stop rotating and separate, as shown in FIG. 6B. To return the pair of resist rollers 30 to the reference position, the moving/driving unit 50 starts moving the pair of resist rollers 30 in the width direction, as shown in FIG. 6C. After the moving to the reference position, the pair of resist rollers 30 are again pressed against each other, and the pair of rollers 41 are also again pressed against each other, as shown in FIG. 6D.

Figure 6E:
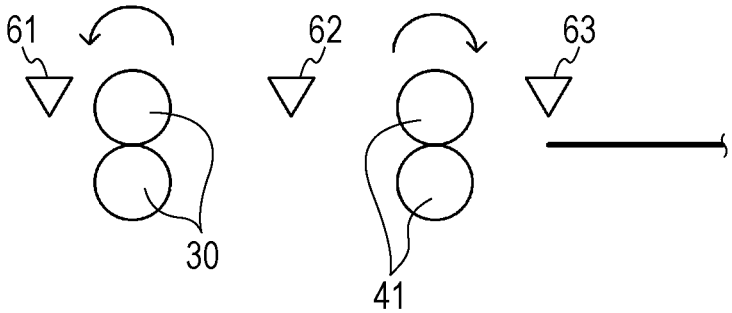
FIG. 6E is a front view illustrating an operation of the pair of resist rollers in the conveyance priority mode.

When the sensor 63 detects the top edge of the next paper sheet, the pair of rollers 41 start rotating forward in the same manner as in the conveyance, and the pair of resist rollers 30 start rotating backward, as shown in FIG. 6E.

Figure 6F:
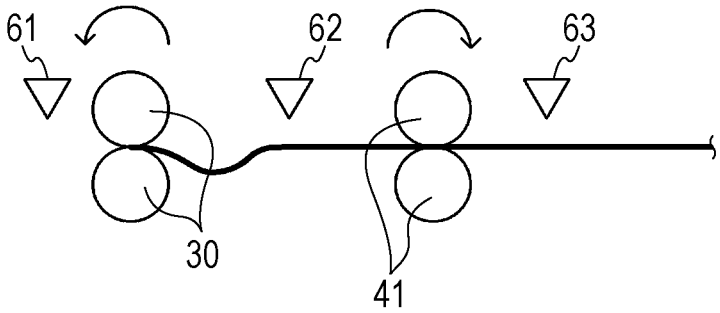
FIG. 6F is a front view illustrating an operation of the pair of resist rollers in the conveyance priority mode.

After the top edge of the paper sheet collides with the nip between the pair of resist rollers 30 rotating backward, the paper sheet is further conveyed by the pair of rollers 41 rotating forward until the paper sheet is bent, as shown in FIG. 6F. In this manner, the top edge of the paper sheet aligns against the nip line, and the tilt of the paper sheet is corrected. After that, the pair of resist rollers 30 are made to rotate forward as shown in FIG. 6A, and nip the paper sheet.

In the operations shown in FIGS. 6A through 6F, even after the top edge of the paper sheet reaches the pair of secondary transfer rollers 23, the pair of resist rollers 30 can assist sheet conveyance until the bottom edge of the paper sheet passes therethrough. Thus, the conveying performance is improved. However, the operations to prepare for conveyance of the next paper sheet cannot be started before the bottom edge of the paper sheet passes through the pair of resist rollers 30. In the operations shown in FIGS. 5A through 5E, on the other hand, the operations to prepare for conveyance of the next paper sheet are completed before the bottom edge of the paper sheet passes through the pair of resist rollers 30. Accordingly, the conveyance of the next paper sheet can be started immediately after the passing, and the sheet conveyance speed can be increased. Thus, high productivity is achieved. After the conveyance of the paper sheet by the pair of secondary transfer rollers 23 is started, the pair of resist rollers 30 start separating, and therefore, stop assisting the conveyance. However, the pair of resist rollers 30 are again pressed against each other and resume the assistance before the bottom edge of the paper sheet passes therethrough. Thus, conveyance defects, such as shifting, oblique passing, or slippage of the bottom edge of the paper sheet, can be prevented, and sufficiently high conveying performance can be achieved.

As described above, by virtue of the operations shown in FIGS. 5A through 5E, productivity can be increased while sufficiently high conveying performance is achieved. In some cases, however, priority should be put on high conveying performance rather than on high productivity, depending on the image forming condition in the sheet conveyance path to the pair of resist rollers 30, for example.

For example, as shown in FIG. 3, the conveyance path Da from the sheet feed tray T1 or 25 to the pair of resist rollers 30 is straight, and accordingly, the load on a paper sheet in the conveyance path is small. It is thus possible to achieve sufficiently high conveying performance even when the conveyance control to achieve high productivity is performed, regardless of the basis weight and the size of the paper sheets.

Meanwhile, the conveyance path Db from the conveyance path 26 to the pair of resist rollers 30 has the bent portion. If the paper sheet has a small basis weight and is soft, or if the size of the paper sheet is small in the conveyance direction, and the bottom edge of the paper sheet has already passed through the bent portion at the time when the top edge of the paper sheet reaches the pair of secondary transfer rollers 23, sufficiently high conveying performance can be achieved even when the conveyance control to achieve high productivity is performed. However, in a case where the paper sheet has a large basis weight and is hard like cardboard, and the size in the conveyance direction is so large that the paper sheet still remains at the bent portion when the top edge of the paper sheet reaches the pair of secondary transfer rollers 23, the conveyance load on the paper sheet passing through the bent portion is large. To prevent conveyance defects under such an image forming condition with a large conveyance load, the conveyance control that puts priority on conveying performance as shown in FIGS. 6A through 6F is preferable to the conveyance control that puts priority on productivity as shown in FIGS. 5A through 5E.

In view of this, the series of operations of the pair of resist rollers 30 shown in FIGS. 6A through 6F are regarded as the conveyance priority mode, and the series of operations of the pair of resist rollers 30 shown in FIGS. 5A through 5E are regarded as the productivity priority mode. The control unit 11 preferably selects one of the priority modes in accordance with the image forming condition.

Figure 7:
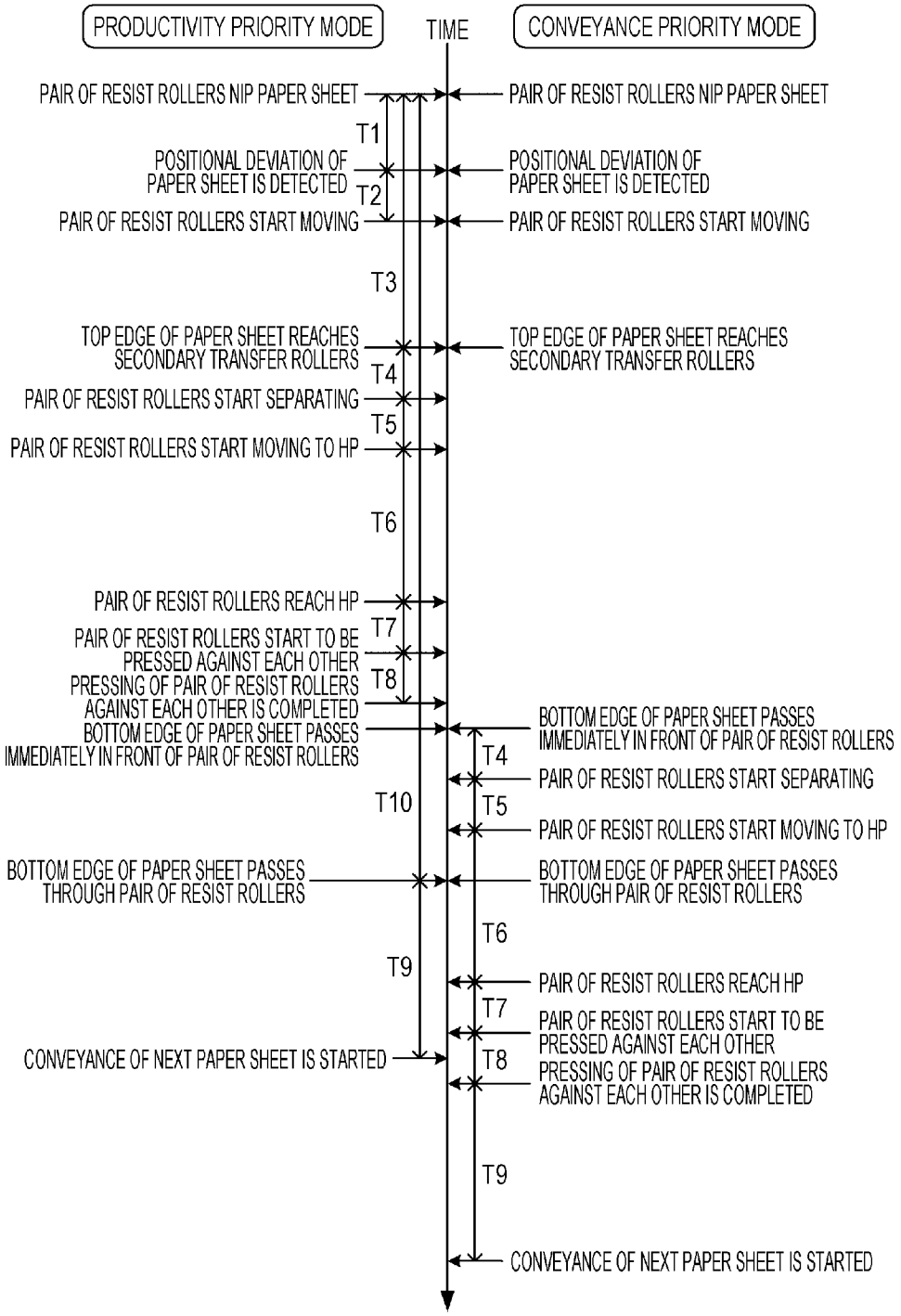
FIG. 7 is a timing chart showing the control on the operations of the pair of resist rollers in the conveyance priority mode and in the productivity priority mode.

FIG. 7 is a timing chart showing the control on the operations of the pair of resist rollers 30 in the conveyance priority mode and in the productivity priority mode.

In FIG. 7, T3 represents the time since the nipping of a paper sheet by the pair of resist rollers 30 till the arrival of the top edge of the paper sheet at the pair of secondary transfer rollers 23, and T10 represents the time until the bottom edge of the paper sheet passes through the pair of resist rollers 30.

Before the top edge of the paper sheet reaches the pair of secondary transfer rollers 23, the operation of the pair of resist rollers 30 is the same both in the productivity priority mode and in the conveyance priority mode. When the sensor 61 detects a positional deviation of the paper sheet after the pair of resist rollers 30 nip the paper sheet, the pair of resist rollers 30 start moving away from the reference position (HP). In FIG. 7, T1 represents the time since the nipping of the paper sheet till the detection of a positional deviation of the paper sheet by the sensor 61, and T2 represents the time since the detection of the positional deviation till the start of the moving of the pair of resist rollers 30 for positional deviation correction.

After the top edge of the paper sheet reaches the pair of secondary transfer rollers 23, the operations to prepare for conveyance of the next paper sheet are started after a time T4 has passed in the productivity priority mode. First, the pair of resist rollers 30 start separating. After a time T5 has passed since the start of the separation, the pair of resist rollers 30 start moving to the reference position (HP). The time required since the start of the moving till the end of the moving is represented by T6. After a time T7 has passed since the end of the moving, the pair of resist rollers 30 start being pressed against each other. The time required since the start of the pressing till the end of the pressing is represented by T8. When a time T9 has passed since the end of the pressing of the pair of resist rollers 30 against each other, conveyance of the next paper sheet is started.

In the productivity priority mode, the control unit 11 controls the timing to start separating the pair of resist rollers 30, the timing to start pressing the pair of resist rollers 30 against each other, and the timing to start moving the pair of resist rollers 30, so that the time since the nipping of the paper sheet by the pair of resist rollers 30 till the completion of the preparation for conveyance of the next paper sheet, or the total time of the times T3 through T8, becomes shorter than the time T10 since the nipping of the paper sheet by the pair of resist rollers 30 till the passing of the bottom edge of the paper sheet at the pair of resist rollers 30. The times T3, T6, T8, and T10 are determined by the size of the paper sheet, the conveyance speed, and the like. Therefore, the control unit 11 can adjust the total time of the times T3 through T8 to a shorter time than the time T10 by shortening the times 14, T5, and T7.

The flow in the operations to prepare for conveyance of the next paper sheet in the conveyance priority mode is the same as that in the productivity priority mode, except for the timing to start. Specifically, in the conveyance priority mode, the operations to prepare for conveyance of the next paper sheet are started not when the top edge of the paper sheet reaches the pair of secondary transfer rollers 23 but when the sensor 62 detects the bottom edge of the paper sheet passing in front of the pair of resist rollers 30.

In the productivity priority mode, the operations to prepare for conveyance of the next paper sheet are completed before the bottom edge of the paper sheet passes through the pair of resist rollers 30. Accordingly, conveyance of the next paper sheet can be started immediately after the time T9 has passed since the passing, and the sheet conveyance speed can be made higher than that in the conveyance priority mode in which the operations to prepare for conveyance of the next paper sheet are started after the bottom edge of the paper sheet has passed in front of the pair of resist rollers 30. Thus, high productivity can be achieved. In the conveyance priority mode, on the other hand, the pair of resist rollers 30 can assist the conveyance of the paper sheet for a long time after the pair of secondary transfer rollers 23 nip the paper sheet. Accordingly, the conveying performance is higher than that in the productivity priority mode.

Figure 8:
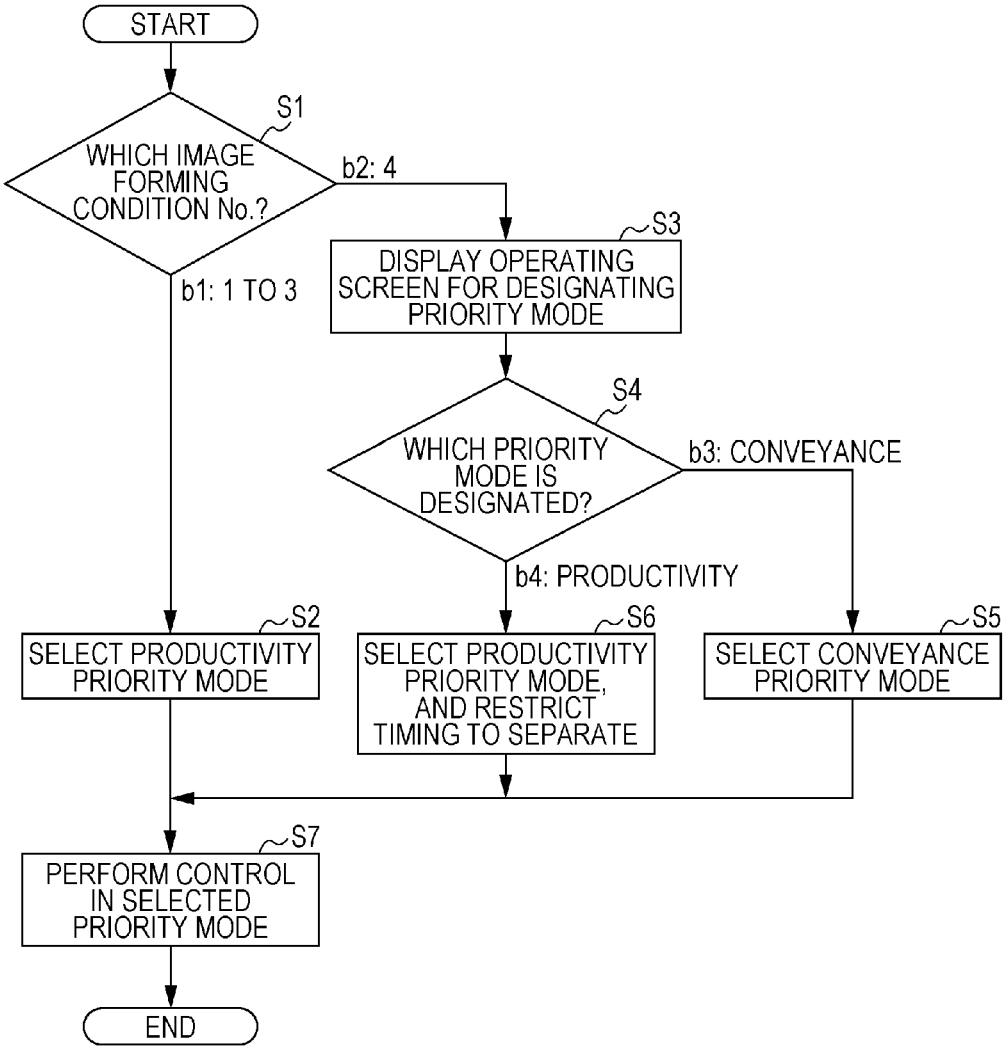
FIG. 8 is a flowchart showing the processing procedures to be carried out by the image forming apparatus to perform conveyance control in accordance with an image forming condition.

FIG. 8 shows the processing procedures to be carried out when the image forming apparatus G selects a priority mode and perform sheet conveyance control.

As shown in FIG. 8, in the image forming apparatus G, the control unit 11 determines which one of the image forming conditions 1 through 4 shown in FIG. 9 matches the image forming condition of the job (step S1).

FIG. 9 is a table showing the correspondence between the image forming conditions 1 through 4 and the priority modes that can be selected under the respective image forming conditions 1 through 4.

As described above, in a case where the conveyance path to the pair of resist rollers 30 is the conveyance path Da, sufficiently high conveying performance can be achieved, regardless of the basis weight and the size of the paper sheet. Accordingly, in the case of the image forming condition 1 in which the sheet conveyance path is the conveyance path Da, the productivity priority mode can be selected for a paper sheet of any basis weight and size, as shown in FIG. 9.

In the conveyance path Db, the productivity priority mode can be selected for a paper sheet that is soft or is shorter than the distance d from the pair of secondary transfer rollers 23 to the bent portion. In the case of a paper sheet that is hard and is longer than the distance d, it is preferable to make the user designate the productivity priority mode or the conveyance priority mode.

A paper sheet with a larger basis weight is harder. Therefore, the basis weight is increased stepwise, and conveyance control is performed in the productivity priority mode. The basis weight with which the conveying performance starts deteriorating is set as the threshold. Paper sheets having larger basis weights than the threshold can be determined to be hard paper sheets, and paper sheets having smaller basis weights than the threshold can be determined to be soft paper sheets.

In a case where the basis weight threshold is 180 g/m$^2$, and the distance d is 240 mm, the productivity priority mode can be selected under the image forming condition 2 in which the basis weight of a paper sheet is not greater than 180 g/m$^2$, or under the image forming condition 3 in which the size of a paper sheet in the conveyance direction is not larger than 240 mm, even if the sheet conveyance path is the conveyance path Db, as shown in FIG. 9. In the case of the image forming condition 4 in which the sheet conveyance path is the conveyance path Db, the basis weight of the paper sheet to be used exceeds 180 g/m$^2$, and the size of the paper sheet in the conveyance direction is larger than 240 mm, the user is made to designate the productivity priority mode or the conveyance priority mode.

The conveyance path to the pair of resist rollers 30 can be determined by whether the print job is set for one-side printing or whether the print job is set for two-side printing. If the print job is set for two-side printing, the conveyance path Db is used in forming an image on the back surface. Therefore, the control unit 11 can determine the conveyance path Db to be the sheet conveyance path. In the case of one-side printing, the control unit 11 can determine the conveyance path Da to be the sheet conveyance path.

As for the basis weight and the size of each paper sheet, the basis weight and the size of the paper sheets stored in the sheet feed tray designated at the time of print setting can be determined to be the basis weight and the size of all the pages of the paper sheets. For example, in the case of the sheet feed tray 25 storing paper sheets that are 65 g/m$^2$ in basis weight and are A4 in size, the basis weight of each page of the paper sheets can be determined to be 65 g/m$^2$, and the size of each page of the paper sheets in the conveyance direction can be determined to be 297 mm.

In a case where the image forming condition of the job is determined to be one of the image forming conditions 1 through 3 (step S1: b1), the control unit 11 selects the productivity priority mode (step S2).

In a case where the control unit 11 determines the image forming condition of the job to be the image forming condition 4 (step S1: b2), the display unit 14 displays the operation screen through which the productivity priority mode or the conveyance priority mode can be designated (step S3). In a case where the conveyance priority mode is designated by the user via the operating unit 13 (step S4: b3), the control unit 11 selects the conveyance priority mode (step S5).

In a case where the productivity priority mode is designated by the user (step S4: b4), the control unit 11 selects the productivity priority mode. In this case, to achieve sufficiently high conveying performance, the control unit 11 restricts the timing for the pair of resist rollers 30 to start separating to a time after the bottom edge of the paper sheet nipped by the pair of resist rollers 30 passes through the bent portion of the conveyance path Db in the productivity priority mode (step S6). The timing for the bottom edge of the paper sheet to pass through the bent portion of the conveyance path Db can be calculated from the size of the paper sheet in the conveyance direction and the conveyance speed.

After selecting the productivity priority mode or the conveyance priority mode, the control unit 11 performs sheet conveyance control in the selected priority mode (step S7).

As described above, the image forming apparatus G of this embodiment includes: the pair of resist rollers 30 that are pressed against each other, to nip a paper sheet in the reference position and then convey the paper sheet; and the control unit 11 that controls operation of the pair of resist rollers 30 to correct a positional deviation of the paper sheet, by moving the pair of resist rollers 30 from the reference position in the width direction perpendicular to the sheet conveyance direction after the pair of resist rollers 30 nip the paper sheet. After correcting the positional deviation, the control unit 11 controls the operation of the pair of resist rollers 30 to complete a series of operations (operations to prepare for conveyance of the next paper sheet) so that the pair of resist rollers 30 separate from each other, return to the reference position, and are again pressed against each other before the bottom edge of the paper sheet nipped by the pair of resist rollers 30 passes through the pair of resist rollers 30.

With this mechanism, conveyance of the next paper sheet can be started immediately after the bottom edge of the paper sheet nipped by the pair of resist rollers 30 passes through the pair of resist rollers 30. The intervals between paper sheets can be shortened, and image formation can be performed at higher speed. Thus, higher productivity can be achieved. To prepare for the next conveyance, the pair of resist rollers 30 temporarily separate from each other and release the paper sheet. However, before the paper sheet passes through the pair of resist rollers 30, the pair of resist rollers 30 again nip the paper sheet, and assist the conveyance of the paper sheet. In this manner, sheet conveyance control with high productivity and sufficiently high conveying performance can be conducted.

The above described embodiment is a preferred example of the present invention, and the present invention is not limited to this example. Modifications can be made to the embodiment without departing from the scope of the invention.

For example, in the above described embodiment, the pair of resist rollers 30 and the pair of secondary transfer rollers 23 are described as an example of the pair of first rollers and an example of the pair of second rollers. However, the present invention can also be applied to other pairs of rollers that are used for correcting positional deviations of paper sheets.

Furthermore, to extend the conveyance assisting time of the pair of resist rollers 30 and improve the conveying performance in the conveyance priority mode, the timing for the pair of resist rollers 30 to start separating to prepare for conveyance of the next paper sheet may be immediately after the bottom edge of the paper sheet passes through the pair of resist rollers 30.

Although the present invention has been described and illustrated in detail, it is clearly understood that the same is by way of illustrated and example only and is not to be taken by way of limitation, the scope of the present invention being interpreted by terms of the appended claims.

What is claimed is:

1. An image forming apparatus comprising:

a pair of first rollers configured to nip a paper sheet in a reference position and convey the paper sheet, the pair of first rollers being pressed against each other;

a first sensor to detect a positional deviation of the paper sheet a second sensor to detect a bottom edge of the paper sheet and a control unit configured to control operation of the pair of first rollers to correct the positional deviation in a width direction of the paper sheet, by moving the pair of first rollers from the reference position in the width direction perpendicular to a direction of conveyance of the paper sheet after the pair of first rollers nip the paper sheet, wherein, after correcting the positional deviation, the control unit controls the operation of the pair of first rollers, to complete a series of operations for the pair of first rollers to separate from each other, to return to the reference position, and to be again pressed against each other, before the bottom edge of the paper sheet nipped by the pair of first rollers passes through the pair of first rollers.

2. The image forming apparatus according to claim 1, further comprising a pair of second rollers adjacent to a downstream side of the pair of first rollers in the direction of conveyance of the paper sheet, wherein the control unit controls the pair of first rollers to start separating from each other when a top edge of the paper sheet nipped by the pair of first rollers reaches the pair of second rollers.

3. The image forming apparatus according to claim 2, wherein the control unit selects one of a productivity priority mode and a conveyance priority mode in accordance with a conveyance path of the paper sheet and a basis weight and a size of the paper sheet input into the control unit, in the productivity priority mode, the control unit performs control to complete the series of operations before the bottom edge of the paper sheet nipped by the pair of first rollers passes through the pair of first rollers, and, in the conveyance priority mode, the control unit performs control to start the series of operations immediately before or after the bottom edge of the paper sheet nipped by the pair of first rollers passes through the pair of first rollers.

4. The image forming apparatus according to claim 3, wherein, when the conveyance path of the paper sheet is a conveyance path including a bent portion, the basis weight of the paper sheet is greater than a threshold, and the size of the paper sheet in the conveyance direction is longer than a conveyance path from the pair of second rollers to the bent portion, the control unit performs control in a priority mode designated by a user between the productivity priority mode and the conveyance priority mode.

5. The image forming apparatus according to claim 4, wherein, when the productivity priority mode is designated by the user, the control unit restricts the timing for the pair of first rollers to start separating from each other to a time after the bottom edge of the paper sheet nipped by the pair of first rollers passes through the bent portion of the conveyance path.

6. The image forming apparatus according to claim 1, wherein, when the pair of first rollers are again pressed against each other, the control unit controls respective sheet conveyance speeds of the pair of first rollers and the pair of second rollers to synchronize with each other.

7. The image forming apparatus according to claim 1, wherein, when the pair of first rollers are again pressed against each other, the control unit adjusts a moving speed of each roller to a lower speed than a reference speed.

* * * * *